United States Patent [19]

Clapp et al.

[11] Patent Number: 5,046,712

[45] Date of Patent: Sep. 10, 1991

[54] APPARATUS FOR HANDLING WORKPIECES OF LIMP SHEET MATERIAL

[75] Inventors: Timothy G. Clapp, Raleigh, N.C.; William R. Cole, Jr., Shelbyville, Tenn.

[73] Assignee: ARK, Inc., Shelbyville, Tenn.

[21] Appl. No.: 579,807

[22] Filed: Sep. 10, 1990

[51] Int. Cl.[5] ..... B65H 29/66

[52] U.S. Cl. ..... 271/65; 271/310; 271/186

[58] Field of Search ..... 271/65, 309, 310, 176, 271/184–186, 195, 264

[56] References Cited

U.S. PATENT DOCUMENTS

| | | | |
|---|---|---|---|
| 2,819,075 | 1/1958 | Noon | 271/26 |
| 3,168,307 | 2/1965 | Walton et al. | 271/26 |
| 3,168,308 | 2/1965 | Walton et al. | 271/27 |
| 3,547,431 | 12/1970 | Wagner | 271/11 |
| 3,988,062 | 10/1976 | Burton et al. | 271/65 X |
| 4,269,408 | 5/1981 | Heater | 271/186 X |
| 4,364,550 | 12/1982 | Hynes | 271/11 |
| 4,580,771 | 4/1986 | Smith | 271/97 |
| 4,597,573 | 7/1986 | Reba et al. | 271/195 |
| 4,736,942 | 4/1988 | Wiley | 271/284 |

OTHER PUBLICATIONS

Xerox Disclosure Journal, vol. 4, No. 1, Jan./Feb. 1979, "Sheet Stripping from Photoreceptors", Newbury, p. 47.

*Primary Examiner*—David H. Bollinger

*Attorney, Agent, or Firm*—Senniger, Powers, Leavitt & Roedel

[57] ABSTRACT

Apparatus for handling workpieces of limp sheet material including an endless conveyor having a forward-traveling upper reach for conveying workpieces in a forward direction, each workpiece having a leading edge and a trailing edge. An airfoil extends transversely across the upper reach of the conveyor and a manifold rearward of the airfoil may deliver a jet of air in a generally forward direction between the conveyor and the airfoil as the workpiece travels forwardly under the airfoil such that the leading edge portion of the workpiece raises up from the conveyor toward the airfoil. A clamping mechanism forward of the airfoil receives the leading edge portion of the workpiece. A sensor detects the presence of the leading edge portion between the clamping members and sends a signal in response to which the clamping mechanism is activated to clamp the leading edge portion.

8 Claims, 2 Drawing Sheets

APPARATUS FOR HANDLING WORKPIECES OF LIMP SHEET MATERIAL

The U.S. Government has a paid-up license in this invention and the right in limited circumstances to require the patent owner to license others on reasonable terms as provided for by the terms of contract No. DLA 900-87-C-0509 awarded by the Department of Defense.

BRIEF SUMMARY OF THE INVENTION

This invention relates generally to apparatus for handling workpieces of limp sheet material, such as fabric sheet material, as they are moved in a forward direction on a conveyor.

Automated apparel production requires apparatus which is capable of handling limp workpieces of fabric. Moreover, such apparatus preferably can simultaneously convey and handle the workpieces to speed the processing of the workpieces. Apparatus of the same general type as the present invention is shown in co-pending U.S. application Ser. No. 07/553,993, filed July 16, 1990. The disclosure of application Ser. No. 553,993 is incorporated herein by reference. The apparatus of the present invention is considered to be an improvement over that shown in Ser. No. 553,993.

Among the several objects and features of the present invention may be noted the provision of apparatus for handling workpieces of limp sheet material, such as fabric sheet material which can pick up workpieces from a moving conveyor for performance of operations on the workpiece; the provision of such apparatus which is reliable in extended operation; and the provision of such apparatus which will not damage the workpiece.

In general, apparatus for handling workpieces of limp sheet material constructed according to the principles of the present invention comprises an endless conveyor having a forward-traveling upper reach for conveying workpieces in a forward direction, each workpiece having a leading edge and a trailing edge. Pick-up means is provided for grasping a portion of the workpiece adjacent its leading edge and holding the leading edge portion stationary as the upper reach moves continuously forwardly under the pick-up means. The pick-up means includes airfoil means extending transversely across the upper reach of the conveyor, means for delivering a jet of air in a generally forward direction between the conveyor and the airfoil means, and means forward of the airfoil means for clamping the leading edge portion of the workpiece. Sensor means is operable to activate the clamping means. The air jet means is adapted to deliver a jet of air as the workpiece travels forwardly under the airfoil means such that the leading edge portion of the workpiece raises up from the conveyor toward the airfoil and is received in the clamping means. The sensor means detects the presence of the leading edge portion between the clamping members and generates a signal in response to which the clamping means clamps the leading edge portion.

Other objects and features of the present invention will be in part apparent in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
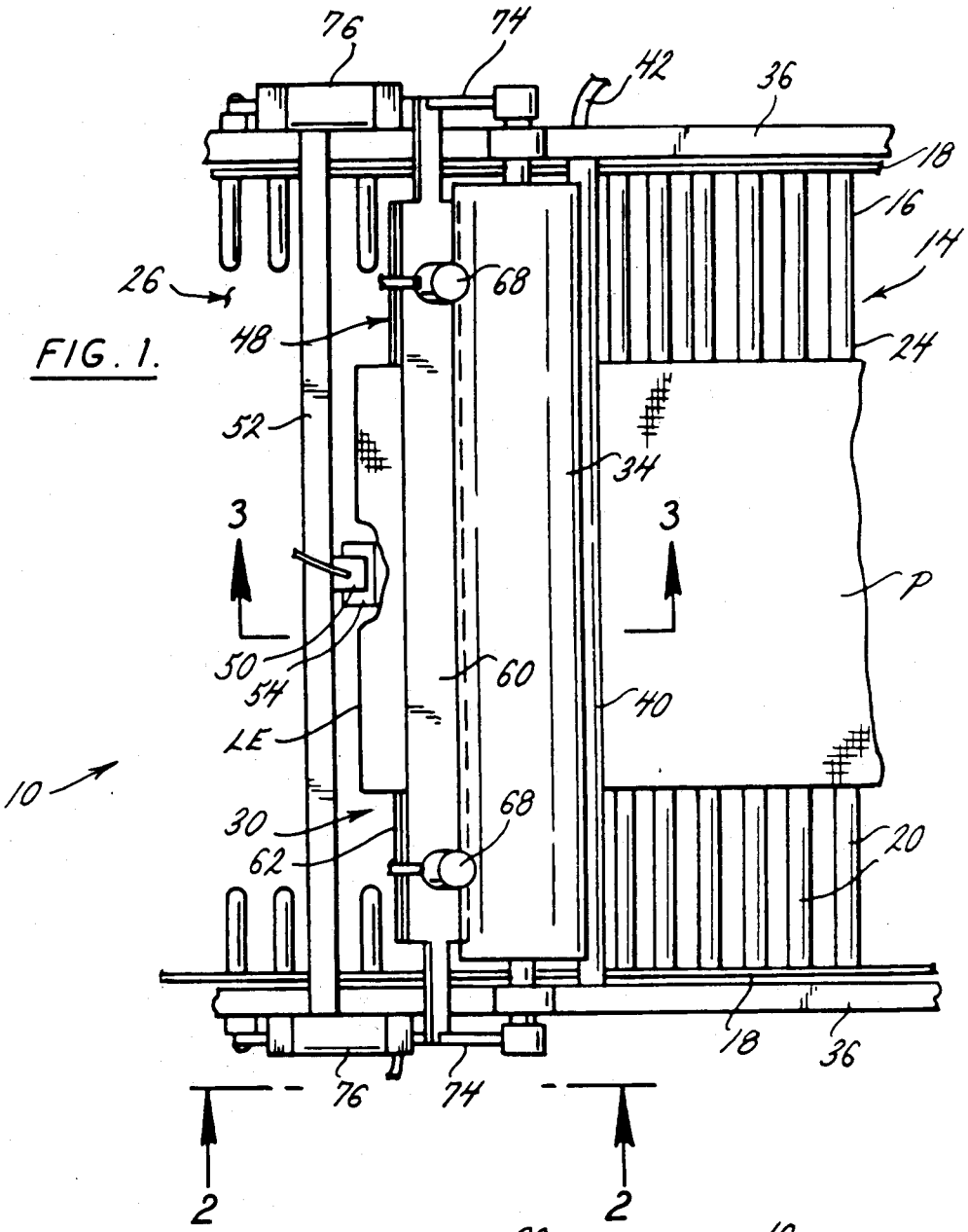
FIG. 1 is a plan view of the apparatus of the present invention.
Figure 2:
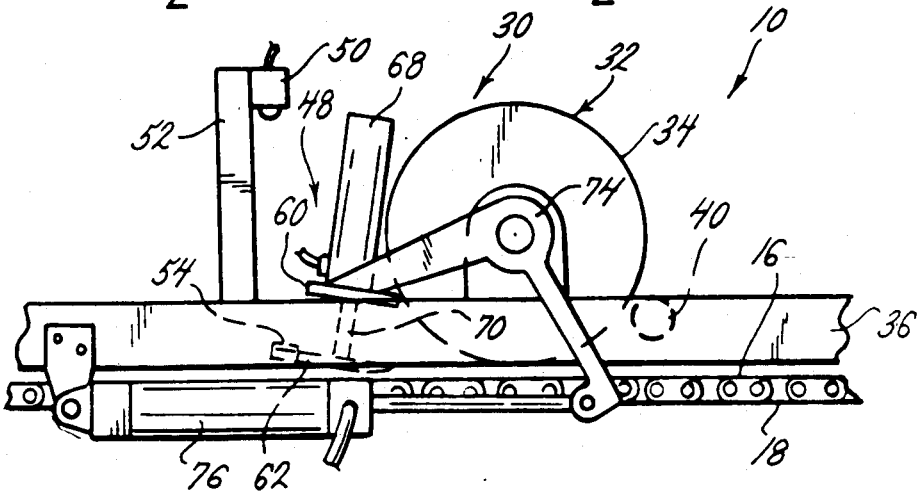
FIG. 2 is a side elevation thereof.

The apparatus of the present invention, indicated generally at 10, is designed for the handling of workpieces of limp sheet material, such as plies P of fabric sheet material for automated processing of the plies. Referring to FIGS. 1 and 2, the apparatus is shown to comprise an endless conveyor, indicated generally at 14, having a forward-traveling upper reach 16 for conveying the plies in a forward direction (from right to left as viewed in FIG. 1). Only the portion of the upper reach 16 of the conveyor necessary for an understanding of the present invention has been illustrated in the drawings. The conveyor 14 is substantially the same as the conveyor disclosed in the co-pending application Ser. No. 07/445,539, filed Dec. 4, 1989, which is incorporated herein by reference. Briefly described, the conveyor 14 includes a pair of endless chains 18 which are driven by suitable means (such as motor 25 in as shown in co-pending application Ser. No. 445,539, filed Dec. 4, 1989). The surface of the conveyor is made up of nylon rods 20 extending transversely with respect to the chains 18 of the conveyor and connected at their opposite ends to the endless chains. As reflected in the drawings, the rods 20 may be in groups defining flights 24, including a leading flight 24L and a trailing flight 24T, which are spaced apart from each other by openings 26 along the length of the conveyor. It is to be understood that the conveyor 14 take other forms, such as a continuous belt, and still fall within the scope of the present invention.

Pick-up means, generally indicated at 30, is provided for grasping a portion of the workpiece or "ply" P adjacent its leading edge LE as the ply travels forwardly on the upper reach 16 of the conveyor. As shown in FIG. 2, the pick-up means 30 includes airfoil means 32 in the form of a cylinder 34 extending across the upper reach 16 of the conveyor transverse to the direction of travel of the upper reach. It is to be understood that the airfoil means 30 may take on shapes other than cylindrical (e.g., semi-cylindrical or wing shaped) and still fall within the scope of the present invention. The cylinder 34 is mounted at both ends on a frame 36 of the apparatus in a position closely adjacent the upper reach 16, but with sufficient room for the ply P on the upper reach to pass under it with additional space for passage of air between the ply and the cylinder. A tubular manifold 40 mounted on the frame 36 extends transversely across the upper reach 16 of the conveyor rearward of the cylinder 34 and is connected by hose 42 to a source of air under pressure (not shown). The manifold 40 has a plurality of forwardly facing orifices 44 spaced longitudinally of the manifold through which the pressurized air escapes in jets directed forwardly between the upper reach 16 of the conveyor and the cylinder 34. Clamping means, indicated generally at 48, forward of the cylinder 34 is operable to clamp the portion of the ply P adjacent its leading edge LE.

The manifold 40 delivers the jets of air from its orifices 44 as the ply P travels forwardly under the cylinder 34. The cylinder 34 acts as an airfoil, producing an expansion of the air on the forward side of the cylinder which causes the leading edge portion to raise up from the upper reach 16 of the conveyor 14 toward the cylinder and into the clamping means 48. Sensor means, comprising photoelectric eye 50 is mounted on a support member 52 extending over the upper reach 16 of the conveyor 14, is operable to activate the clamping means 48. The photoelectric eye 50 includes a light source and a detector for detecting light reflected from the source by a strip of reflective material 54 (FIG. 2) mounted on the clamping means 48. The photoelectric eye 50 is adapted to detect the presence of the leading edge portion of the ply P in the clamping means and to generate a signal causing activation of the clamping means 48 to clamp the leading edge portion.

Figure 3:
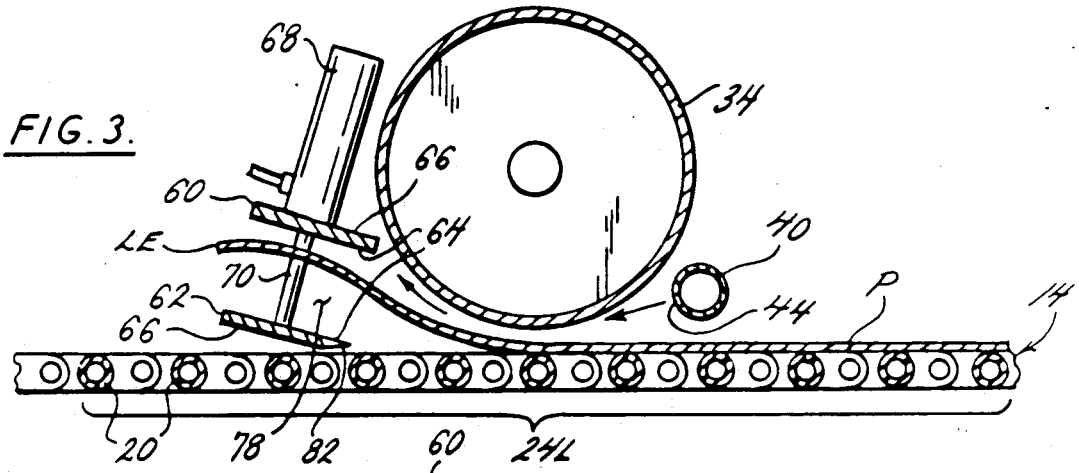
FIGS. 3–5 show an embodiment of the apparatus of the present invention for inversion of workpieces of limp sheet material.
Figure 4:
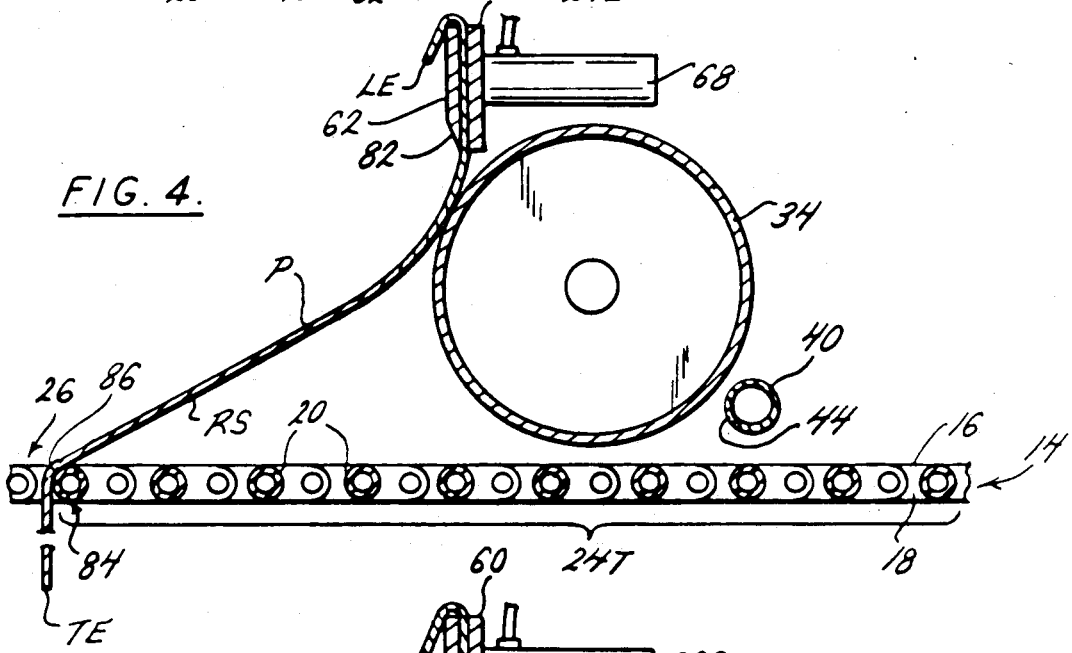

The clamping means 48 includes opposing elongate upper and lower clamping bars (broadly "clamping members"), indicated at 60 and 62, respectively, which are movable between an open position in which the clamping bars are apart (FIG. 2) and a closed position in which the clamping bars are substantially together for clamping the leading edge portion of the ply between them (FIG. 4). The clamping bars 60, 62 are generally rectangular in cross section and each clamping bar has an inner surface 64 facing the inner surface of the other clamping bar and an outer surface 66. Two air cylinders 68 mounted on the outer surface 66 of the upper clamping bar 60 have arms 70 extending through the upper clamping bar 62. The lower clamping bar 62 is attached to the ends of the arms. The arms 70 are retractable from their position shown in FIG. 2 to move the lower clamping bar 62 toward the upper clamping bar 60 to bring the clamping bars to their closed position (FIG. 4). The upper clamping bar 60 is mounted at each longitudinal end on a crank 74 attached to the frame 36 for pivoting about an axis generally corresponding to the axis of the cylinder 34. Two air cylinders 76, one for each crank 74, are mounted on the frame 36 and are operable to pivot the crank such that the clamping bars 60, 62 are raised upwardly from the position shown in FIG. 3 to that shown in FIG. 4 after the leading edge portion of the ply P has been clamped by the clamping bars.

The clamping bars 60, 62 are adapted to facilitate movement of the leading edge portion of the ply P from the upper reach 16 of the conveyor 14 to a position between the clamping bars, As may be seen in FIG. 2, the inner surfaces 64 of the clamping bars lie generally in planes oblique to the direction of travel of the upper reach 16 of the conveyor which slope upwardly in a forward direction. Therefore, the space 78 between the clamping bars 60, 62 at their rearward edge faces slightly downward for receiving the upwardly moving leading edge portion. When the leading edge portion of the ply P moves upward from the upper reach 16 of the conveyor it contacts the outer surface 66 of the lower clamping bar 62 which is shaped to facilitate passage of the leading edge portion across it and to a Position between the clamping bars. In the preferred embodiment, the outer surface has a bevel 82 in its rearward edge which extends generally forwardly and downwardly from the rearward edge of the inner surface 64 of the lower clamping bar 62. It is to be understood that the outer surface 66 of the lower clamping bar may have other shapes which facilitate movement of the part of the leading edge portion which contacts the outer surface rearwardly to the rearward opening 78 between the upper and lower clamping bars 60, 62.

Figure 5:
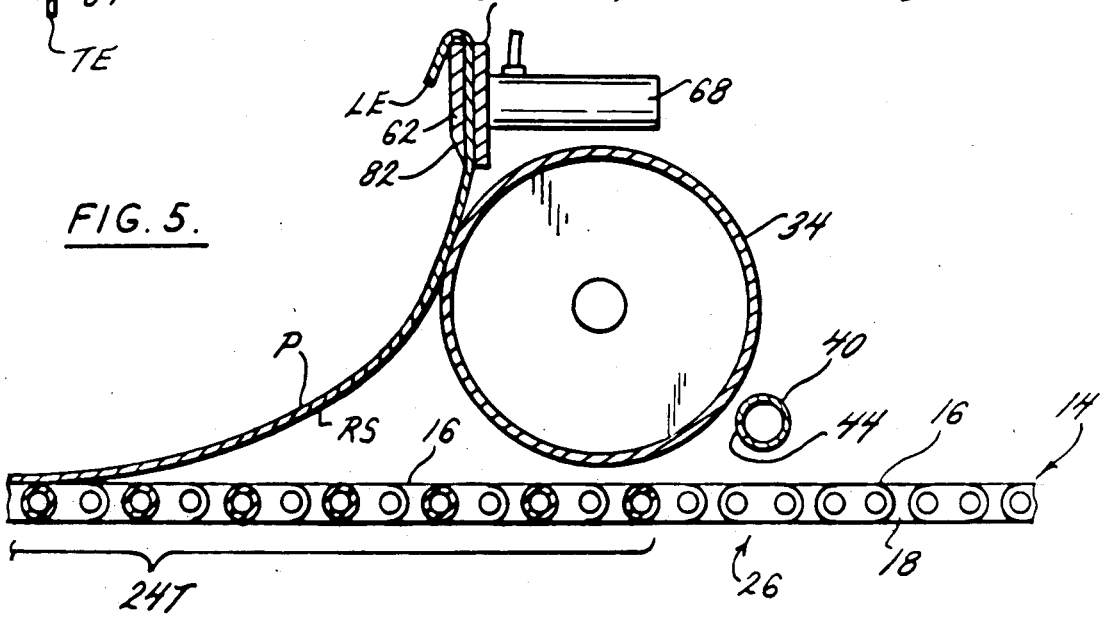

FIGS. 3-5 of the drawings illustrate a preferred embodiment of the present invention in which the apparatus is configured to invert plies P of limp fabric sheet material. As may be seen in FIG. 4, after the leading edge portion is lifted by the raising of the clamping bars 60, 62, a trailing edge portion of the ply extends downwardly from the clamping bars and contacts the upper reach 16 of the conveyor. The trailing edge portion tends to move forwardly on the upper reach 16 beneath the leading edge portion, which is held stationary by the clamping bars 60, 62, toward an inverted position. To complete the inversion, pusher means, generally indicated at 84, is provided for acting on a generally rearwardly facing surface RS of the trailing edge portion of the ply P for pushing the trailing edge portion forwardly. The preferred embodiment corresponds to the second embodiment disclosed in application Ser. No. 553,993 (see FIGS. 6-8) in which the conveyor has a plurality of flights. Forward movement of the leading flight 24L causes the trailing edge TE and parts of the trailing edge portion to fall through an opening between the leading flight 24L and the trailing flight 24T. As shown in FIG. 5, the pusher means 84 comprises a leading surface 86 of the trailing flight 24T (that is, the forward edge of the leading rod in the trailing flight). The leading surface 86 engages the generally rearwardly facing surface RS of the trailing portion, pushing the trailing portion forwardly. The clamping bars 60, 62 continue to hold the leading edge portion of the ply P stationary such that the trailing edge portion moves under and forward of the leading edge LE, to complete the inversion of the trailing portion. The clamping bars 60, 62 then open so that the leading edge LE drops to the trailing flight 24T in a position rearward of the trailing edge TE and with the ply P completely inverted. It is to be understood that other types of pusher means 84 could be used, including specifically those shown in application Ser. No. 553,993.

In operation, the apparatus carries the ply P is carried on the leading flight 24L of the conveyor 14 to the pick-up means 30. As the leading edge portion passes under the cylinder 34, a charge of compressed air is released from the source (not shown) to the manifold 40 which directs jets of air forwardly between the cylinder 34 and the upper reach 16 of the conveyor. The compressed air is released intermittently in the preferred embodiment in order to conserve compressed air, but the pick-up means 30 will also operate with continuously flowing jets of air from the manifold 40. The expansion of the air on the forward side of the cylinder 34 causes the leading edge portion to raise upwardly toward the cylinder as it continues to move forwardly with the flight 24L. The leading edge portion engages the outer surface 66 of the lower clamping bar 62, moving rearwardly to the space 78 between the clamping bars at their rearward edges. Movement across the outer surface 66 of the lower clamping bar 62 to the space 78 is facilitated by the bevel 82 at the rearward edge of the outer surface. Thus it may be seen that the apparatus of the present invention may reliably pick up plies P from a continuously moving conveyor 14 without contact of the pick-up means 30 with the conveyor which could result in damage to the pick-up means and failure of the apparatus in extended use.

Upon reaching the space 78, the leading edge portion moves between the clamping bars 60, 62 with a portion protruding forwardly from between the clamping bars (FIG. 1). The photoelectric eye 50 and sheet of reflective material 54 are positioned with respect to each other so that an approximately ⅛" protrusion of the leading edge portion forward of the clamping bars covers the reflective material, interrupting the reflected light detected by the eye. Interruption of the reflected light causes the eye to generate a signal sent to a controller (not shown) which activates, on a time basis, the air cylinders 68 to move the clamping bar 62 upwardly to bring the clamping bars 60, 62 together for clamping the leading edge portion therebetween. The controller is the same as that disclosed in application Ser. No. 553,993 (the Shark X-903 controller sold by Reliance Electric Corp. through their dealers in major cities). The controller then activates the crank air cylinders 76 to pivot the cranks 74 and raise the clamping bars 60, 62 to lift the leading edge portion further away from the leading flight 24L. Thereafter operations may be performed on the ply such as inversion of the ply as described above.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for handling workpieces of limp sheet material, such as fabric sheet material, the apparatus comprising:

an endless conveyor having a forward-traveling upper reach for conveying workpieces in a forward direction, each workpiece having a leading edge and a trailing edge;

pick-up means for grasping a portion of the workpiece adjacent its leading edge and holding said leading edge portion stationary as the upper reach moves continuously forwardly under said pick-up means, said pick-up means comprising airfoil means extending transversely across the upper reach of the conveyor, means for delivering a jet of air in a generally forward direction between the upper reach of the conveyor and said airfoil means, means forward of said airfoil means for clamping said leading edge portion of the workpiece, and sensor means operable to activate said clamping means;

said air jet means being adapted to deliver a jet of air as the workpiece travels forwardly under said airfoil means such that said leading edge portion of the workpiece raises up from the conveyor toward said airfoil means and is received in said clamping means, said sensor means detecting the presence of said leading edge portion in said clamping means and generating a signal in response to which said clamping means clamps said leading edge portion.

2. Apparatus as set forth in claim 1 wherein said clamping means comprises opposing clamping members movable between an open position in which the clamping members are apart and a closed position in which the clamping members are substantially together, said clamping members being adapted to facilitate movement of said leading edge portion of the workpiece between the clamping members.

3. Apparatus as set forth in claim 2 wherein said sensor means detects the protrusion of part of said leading edge portion of the workpiece forwardly from between said clamping members.

4. Apparatus as set forth in claim 3 further comprising means for pivoting said clamping members upwardly with respect to the conveyor for lifting said leading edge portion away from the conveyor.

5. Apparatus as set forth in claim 4 wherein a trailing edge portion of the workpiece extends downwardly from said clamping members, said trailing portion contacting the conveyor and tending to move forwardly thereon beneath said leading edge portion toward an inverted position, and wherein the apparatus further comprises pusher means adapted to act on a surface of said trailing portion of the workpiece facing generally rearwardly for pushing said trailing portion of the workpiece forwardly to complete the inversion of said trailing portion as said leading edge portion is held stationary by said clamping means.

6. Apparatus as set forth in claim 2 wherein said clamping members comprise upper and lower elongate clamping bars of generally rectangular cross section, each clamping bar having an inner surface facing the inner surface of the other clamping bar and an outer surface, the outer surface of said lower clamping bar being shaped to facilitate passage of said leading edge portion of the workpiece across said outer surface to a position between said clamping bars.

7. Apparatus as set forth in claim 6 wherein the inner surfaces of the clamping bars lie generally in planes oblique to the direction of travel of the conveyor which slope upwardly in a forward direction, and wherein the outer surface of the lower clamping bar is beveled generally at its rearward edge.

8. Apparatus as set forth in claim 1 wherein said air jet means comprises a tubular manifold extending transversely across the upper reach of the conveyor and adapted for carrying air under pressure, the manifold having a plurality of generally forwardly facing orifices spaced longitudinally of the manifold through which the air escapes.

* * * * *